US006499574B1

(12) United States Patent
Anthony

(10) Patent No.: US 6,499,574 B1
(45) Date of Patent: Dec. 31, 2002

(54) VACUUM-PACKED LUGGAGE AND METHOD OF MANUFACTURE

(76) Inventor: Michael M. Anthony, 10189 W. Sample Rd., Parkland, FL (US) 33065

( * ) Notice: Subject to any disclaimer, the term of this patent is extended or adjusted under 35 U.S.C. 154(b) by 183 days.

(21) Appl. No.: 09/631,459

(22) Filed: Aug. 3, 2000

(51) Int. Cl.[7] ..... A45C 13/00

(52) U.S. Cl. ..... 190/36; 190/102; 190/120; 206/524.8

(58) Field of Search ..... 215/228, 262, 215/270; 220/212, 240, 231; 206/829, 543, 524.8; 190/36, 119, 110, 109, 102, 120

(56) References Cited

U.S. PATENT DOCUMENTS 3,000,418 A * 9/1961 Biting ..... 206/524.8 X
3,620,409 A * 11/1971 Rosenbaum ..... 206/524.8 X
4,051,971 A * 10/1977 Saleri et al. ..... 215/260
5,111,919 A * 5/1992 Hamatani et al. ..... 190/109
5,111,938 A * 5/1992 Soprano et al. ..... 206/524.8 X
5,246,114 A * 9/1993 Underwood ..... 206/524.8
5,390,809 A * 2/1995 Lin ..... 220/212
5,485,921 A * 1/1996 Tolendano ..... 206/524.8 X
5,761,992 A * 6/1998 Gallo ..... 99/468
5,806,575 A * 9/1998 Tsay ..... 220/212
6,202,849 B1 * 3/2001 Graham ..... 206/524.8

* cited by examiner

*Primary Examiner*—Allan N. Shoap
*Assistant Examiner*—Tri M. Mai
(74) *Attorney, Agent, or Firm*—Oltman, Flynn & Kubler

(57) ABSTRACT

A vacuum packed suitcase with specially arranged sealable compartments for vacuum sealing of articles of travel such as clothing and makeup accessories, the suitcase including a top cover and a more rigidly constructed bottom receptacle, the bottom receptacle having one or more separate article compartments separated by vertical or horizontal walls for organizing the articles of travel, the top cover and bottom receptacle being airtight when sealed over each other so that after packing the articles of travel the air in the compartments can be removed separately or collectively by means of a vacuum pump, thereby reducing the volume of the articles of travel to a minimum and thus increasing storage efficiency.

4 Claims, 12 Drawing Sheets

VACUUM-PACKED LUGGAGE AND METHOD OF MANUFACTURE

BACKGROUND OF THE INVENTION

1. Field of the Invention

The present invention relates generally to the field of suitcases, luggage and carry-on duffle bags for travel. The terms "baggage", "suitcase", "luggage" and "duffle bags" are considered equivalent for purposes of this application and are used interchangeably. More specifically the present invention relates to a vacuum packed suitcase for easy and effective packing of clothing materials and other items. The invention could also be used for packing and shipping items in a regular box.

The apparatus includes an improved suitcase with specially arranged sealable compartments for vacuum sealing articles of travel such as clothing, makeup accessories, and other items generally accompanying a traveler. The apparatus is preferably constructed in the manner of a traveling bag comprising of a top cover and a more rigidly constructed bottom receptacle; the bottom receptacle serves as storage space for the various articles of travel such as clothing and other items that usually accompany a traveler. The bottom receptacle preferably has one or more separate article compartments separated by vertical or horizontal walls for organizing articles of travel including clothes, toiletry and other items a traveler might need during travel and after reaching a destination.

In conventional suitcases, the article compartments are separated by either zip flaps or internal separation walls that allow the traveler to pack various articles of travel in a well organized manner. However, the compartments are generally not designed to be air-tight. The article compartments could also be located on the outside of the cover, the inside of the cover, the inside of the bottom receptacle or the vertical sidewalls of the bottom receptacle. In all cases, in conventional suitcases, the article compartments are designed with either snap-on closures, keyed locks, velcro closures or zips, which are not air-tight and thus would not be suitable for the purposes of the present invention. Further, prior art discloses suitcases made from materials such as clothing, or leather that are not air-tight. If made from a plastic, the joints and edges of conventional suitcases are generally not sealed to be airtight, since in a conventional suitcase, airtightness is not a necessity. In one embodiment of the present invention, the apparatus is an improved suitcase apparatus, designed to be completely airtight and sealable by vacuum, so that the apparatus minimizes the volume required to store the articles of travel, thus achieving a higher volume of available storage space for articles of travel stored therein. In another embodiment of the invention, the outer shell of the apparatus need not be air-tight, but the internal compartments have covers that form sealed chambers for vacuum packing articles of travel. Further, in yet another embodiment of the present invention, the apparatus can be designed with a tough sealing outer bottom receptacle and sealing top cover, so that the when a vacuum is applied inside the apparatus, the apparatus top cover and bottom receptacle will be self-sealing and will advantageously be pressure locked together by a vacuum force and would not be easy to open without a special vacuum lock and key. Preferably the apparatus is designed to accept or incorporate a built-in vacuum pump means that is either electrically powered or manually powered for applying a vacuum inside the article storage chambers so that articles of travel can be vacuum packed during travel. Also, an external vacuum pump fitting can be attached to the apparatus to apply a vacuum using a conventional vacuum cleaner hose attachment to achieve the same effect.

In the simplest embodiment of the apparatus, the top covers and bottom receptacle are designed to be airtight when sealed over each other. Separate internally arranged sealable article compartments with compartment covers are incorporated to form sealed storage chambers, so that after packing articles of travel in said storage chambers, the air in the said storage chambers can be removed from each storage chamber or from a collection of storage chambers, separately or collectively by means of a vacuum pump, thus reducing the volume of the articles of travel to a minimum by removing the air contained in them. Preferably, the vacuum pump means removes a substantial part of the air from the storage chambers, and from articles of travel so as to reduce the volume required to store said articles of travel to a minimum, thereby increasing the storage efficiency of the apparatus and also improving the security of the articles of travel during transportation. Advantageously, the integrity of the vacuum also serves as an indicator of a breach in the integrity of the apparatus.

In the preferred embodiment of the invention, each article compartment is designed to be airtight, so that if the walls are constructed from a porous material, a substantial part, or all of the walls of the article compartment and the compartment cover are lined with a thin plastic film that serves to seal the storage chambers. The compartment cover is also made of a sealing plastic material, or preferably cloth or leather material lined with a sealing plastic film or liner. The compartment cover is sealably attached to the article compartment by means of an airtight plastic zip-lock or by means of a tongue and groove snap-on seal that attaches the compartment cover to the article compartment forming an airtight article storage chamber. All the storage chambers have built-in check-valves that allow air to bleed in and out of the storage chamber as desired. When articles of travel are stored in the article compartment and the compartment cover is sealably attached to the article compartment, the air trapped in the articles of travel and the unuseable space in the storage chamber can be evacuated to minimize the storage chamber volume allowing more articles of travel to be stored in the apparatus than would otherwise be possible. When access is need to the articles of travel, the a bypass valve comprising a vacuum release valve is simply opened to allow air to rush back into the storage chamber through the compartment cover or through the article compartment vertical sidewalls. The storage chambers can be sealed independently or collectively as needed.

The apparatus is further designed to be easily manufactured, so that the processes that would be encountered during the manufacturing would be easily accomplished because of the way the compartments are designed. Preferably, the apparatus is designed and manufactured in the manner of conventional suitcases with the added use of a thin airtight lining material for the purpose of making the walls of the storage chambers within the apparatus airtight. After articles of travel have been placed into the article compartments, they may be bulky and fluffy because the elasticity of the materials of clothing, for example, will cause the clothing to trap air in its pores. Thus the compartment cover is preferably designed to be large enough to completely enclose the additional volume occupied by the bulky, fluffy articles of travel prior to evacuating the storage chambers and the articles of travel stored therein. When the compartment cover is placed over the packed article compartments, it must enclose the bulk of the articles of travel and form a continuous seal around the opening of the article compartment, sealing the articles of travel therein. Thus, the compartment cover must be made to have an excess retention volume that will accommodate the articles of travel after packing without hindrance to the mating of and the sealability of the said article compartments and the compartment covers. The compartment cover may be as much as twice as deep as the compartment vertical side walls, so that when articles of travel are loaded into the article compartments, the compartment cover can be wrapped over said articles of travel, forming a bulge that is far in excess of what the apparatus would be able to store under normal conditions. A vacuum check valve is seating attached to either the compartment cover, or to the compartment vertical sidewalls, so that when a vacuum is applied to the sealed storage chamber thus formed, a substantial volume of the air within the sealed storage chamber can be removed reducing the bulk of the articles of travel to a minimum, and thus flattening the compartment cover against the articles of travel to compress them into the storage chamber to the smallest possible storage volume.

A compartment seal is provided around the rim of the vertical sidewalls of the articale compartments. Said compartment seal is designed to seal and interlock with a matching compartment cover seal so that very little or no air can escape from the storage chamber after it has been evacuated. Preferably, the compartment cover seal is a plastic sealing and interlocking rubber or plastic seal shaped to mate sealingly with the compartment seal, so that upon mating, the two seals will form an airtight sealed rim around the storage chamber.

Other improvements to the apparatus include a built-in check valve and vacuum fitting that allows air to be removed from the storage chamber by a vacuum pump means, and allows air to enter the storage chamber manually by a manual override means.

The method of manufacture and use generally involve the broad steps of making an apparatus bottom receptacle with article compartments for storing articles of travel therein; making a top cover using conventional and known manufacturing technics; using coated fabrics that have no permeability to air; applying or forming a plastic film on the apparatus walls by either spraying said apparatus walls with a plastic sealing material or by thermally bonding a plastic material to said apparatus walls prior to manufacturing the apparatus or after manufacturing the apparatus; attaching a top cover seal to the top cover rim; applying a bottom receptacle seal to the bottom receptacle rim; said bottom receptacle seal sealingly mating with said top cover seal to the form an airtight sealed apparatus; attaching a check valve and vacuum fitting means to the either the bottom receptacle vertical sidewalls or to the top cover; attaching a vacuum release means to either top cover or to the bottom receptacle vertical sidewalls for easy access to the outside of the apparatus; attaching compartment seals on the compartments vertical sidewalls; attaching a compartment cover seal to the compartment cover; said compartment seal sealingly mating with said compartment cover seal to the form an airtight sealed storage chamber; attaching a check valve and vacuum fitting means to the either the compartment cover or to the compartment vertical sidewalls; attaching a vacuum release means to either compartment cover or to the compartment vertical sidewalls; packing said apparatus by placing articles of travel within the storage chambers; attaching the compartment cover to the article compartments by mating the seals to for an airtight storage chamber by causing said compartment seal to mate and interlock with said compartment cover seal to the form an airtight sealed storage chamber with articles of travel stored therein; evacuating said storage chambers by attaching a vacuum generating means to said check valve and vacuum fitting means; evacuate the storage chamber to remove a substantial volume of air within the storage chamber; said check valve and vacuum fitting means configured to allow air to only pass from the inside of the storage chamber to the atmosphere; said vacuum release means allowing air to rush back into the storage chamber traveling when manually activated; activating said vacuum release means to manually allow air to rush back into the storage chamber and release the vacuum hold of the apparatus compartment cover and the article compartment to access the articles of travel.

2. Description of the Prior Art

There have previously been suitcase designs with compartmentalized storage chambers for articles of travel. Articles of travel for the most part comprise clothing which retains a lot of dead airspace between fibers. These prior designs offer innovative compartmentalized storage chamber designs that allow the user pack articles of travel in an efficient and effective manner for easy retrieval. However the volumetric packing efficiency of these prior designs is limited to the capacity they can hold articles of travel with the air trapped in said articles of travel. To effective store articles of travel, the user generally mut depress the articles of travel manually or apply a force by hand to said articles of travel in order to minimize their volume. The elastic forces of the fibers of clothing does not allow the clothing to retain a minimum storage configuration without some additional manual force applied to compress them into the storage chambers of the apparatus. This can sometimes lead to loss of neatness, winkling and rumpling of clothing, a situation every traveler must contend with. To solve this problem, some ideas have been developed by others that rely on separately storing clothing in pre-made vacuum bags that can compress the clothing when a vacuum is applied to them. These bags are separate from the suitcase and have no formal shape or design intent other than storing individual clothing item in a pre-compressed state for later storage in a suitcase. Thus several such bags are need to store articles of travel effectively. Further, the separate storage bag systems are designed to be rolled into a cylinder by hand, with the stored articles of clothing in them, so that so that all air is removed from the stored articles of clothing. This can cause wrinkling, rumpling and undesired results when suits and other sensitive clothes that must be stored wrinkle-free are stored using such systems. Further they do not form a simple single integrated system for storing articles of clothing, and are generally bought separately from the suitcases. Further, when such existing systems are used to store clothing in a suitcase, they can move about in the suitcase and offer no anchoring system for the clothing stored in them, so that their efficiency in keeping clothes wrinkle free during storage diminishes considerably. The present invention allows the user to have all the advantages of effective and efficient storage of clothing and other articles of travel, without the disadvantages outlined above. Further, the present invention is a simple and unified method of storing articles of travel in a suitcase without the disadvantages and inconvenience of using separate bags and containers for the same. Further, the apparatus of the present invention allows all the articles of clothing stored inside a suitcase to be kept together and neatly in the confines of the suitcase with little or no wrinkling. Additionally, articles of travel other than clothing could also be stored in the present invention in a secure and confined storage compartment that essentially wraps over them as if they are blister packed for travel. Advantageously, due to the large forces that can be generated by the relatively large areas of suitcase covers and bottom article storage receptacles, the present invention allows a security system to be implemented within the apparatus, that is virtually tamper proof, since the apparatus can be designed to be self-locking and cannot be opened by manual force in the security prone environments of airports and hotels.

It is thus an object of the present invention to provide a vacuum packed apparatus and method of manufacturing the same with sealable and air-tight storage compartments for storing articles of travel in an evacuated state; said storage compartments comprising spacious article storage compartments and a sealing cover means for mating and sealing in an airtight manner, with the said article storage compartments.

It is another object of the present invention to provide a vacuum packed apparatus with one or more air-tight storage compartments for storing articles of travel ; said apparatus having a built-in vacuum pump means; said vacuum pump means powered manually or by electrically to create a vacuum when desired in said storage chambers; said storage chambers having a built-in check valve and vacuum fitting means and a vacuum release means for creating a vacuum in said apparatus and the storage compartments therein.

It is an objective of the present invention to provide an apparatus and method of manufacture, that uses a vacuum to minimize the volume needed to store articles of travel for easy storage; said articles of travel held securely by the shrunk walls of the storage compartment covers during travel.

It is an objective of the present invention to provide an apparatus and method of manufacture, that uses a vacuum to minimize the volume needed to store articles of travel for easy storage with a top cover and a bottom receptacle that mate together and lock with a vacuum force for security purposes.

It is finally an object of the present invention to provide such an apparatus which can be easily manufactured using traditional and known methods of manufacture.

SUMMARY OF THE INVENTION

The present invention accomplishes the above-stated objectives, as well as others, as may be determined by a fair reading and interpretation of the entire specification.

When oriented in the position of normal use, the apparatus includes bottom receptacle having a horizontal and contiguous rigid or flexible bottom wall that is sealing connected at the rim to the bottom rim of vertical sidewalls that can be rigid or flexible. The material of construction of the apparatus either clothing, leather, metal or plastic. If made from material that is porous to air, the material must be lined with a plastic liner or film to make it airtight. The plastic liner or film is either attached to the walls of the apparatus by thermal bonding, gluing or spraying and can be loosely attached, or is formed as part of the structural form of the fabric of construction of the apparatus. The entire apparatus can also be formed from injection molded or vacuum formed plastic material. The vertical sidewalls of the bottom receptacle terminate in a continuous open top rim that is substantially rectangular but could take on any desired shape or size. A hinge attaches a sealing top cover to a vertical sidewall of the bottom receptacle. On the top open rim of the vertical sidewalls of the bottom receptacle is attached a continuous plastic or rubber bottom receptacle seal that can sealingly mate with a top cover seal attached to the open rim of the top cover. The top cover seal is preferably a female groove in cross-section that attaches and fits over a mating male tongue cross-sectioned on the bottom receptacle seal, but they fit can also be reversed as required. When the bottom receptacle seal is sealingly attached to the top cover seal, the apparatus becomes airtight. The hinges are designed not to interfere with the sealing of the top cover with the bottom receptacle, so that advantageously, they are attached to the top cover and the bottom receptacle to fold over the seals and connect the top cover and the vertical sidewalls of the bottom receptacle.

In the case when the apparatus is a simple duffle bag with no particular structure to the sidewalls, the seals of the apparatus are simply designed to interlock and close off the opening of the apparatus to form a sealed container for articles of travel.

The apparatus is preferably constructed in the manner of a flat traveling bag comprising of a top cover and a more rigidly constructed bottom receptacle; the bottom receptacle serves as the storage space for various articles of travel such as clothing and other items that usually accompany a traveler.

In the first preferred embodiment of the invention, apparatus takes the form of a travel luggage, or suitcase with four vertical sidewalls that are sealingly connected to a bottom receptacle wall to form a bottom receptacle. The bottom receptacle preferably has one or more separate article compartments made by separate internally arranged compartment vertical sidewalls. These article compartments are used by a traveler to organize articles of travel including clothes, toiletry and other items needed during travel and after reaching a destination.

In the first embodiment, the article compartments are separated by compartment vertical sidewalls terminating in separate continuous open compartment seals that can be sealingly mated with compartment cover seals to form sealed-off storage chambers within the bottom receptacle of the apparatus. Advantageously, the apparatus can have an overall outer sealed structure with separately sealed internal storage chambers. Each storage chamber is sealed separately by a sealing compartment cover. Each compartment rim is designed with a compartment seal edge. The compartment seal is preferably a female groove in cross-section that attaches and fits over a mating male tongue cross-sectioned compartment cover seal. The compartment cover seal and the compartment seal could also be designed as a sealing zip, so that conventional sealing and airtight zips could also be used in each case where needed. Other methods of sealing could be used, but they all achieve the same purpose and would accomplish the same result. When the article compartment cover seal is sealingly attached to compartment seal, an article storage chamber is formed that is airtight. Thus, there may be several storage chambers, or just one large internal storage chamber for articles of travel.

A check valve is attached sealingly to the article compartment cover or the compartment vertical sidewalls, so that fluid communication between the inside space of the storage chamber and the outside is only through the said check valve. The check valve can be a conventional off-the shelf check valve of known technology. In its simplest form, the check valve comprises a sealing plastic base, and a snap-on ring that attaches said the check valve to the compartment cover, or the compartment vertical sidewalls through a hole on said compartment cover, or the compartment vertical sidewalls. A hole runs through the plastic sealing base of the check valve, and a rubber flap is placed to centrally align with the hole and seal over it against the sealing base The sealing base is designed as a flat disc with a slight depression that holds a flat disc-shaped thin rubber flap in place. The rubber flap is attached to the disc face to form a seal over the hole. The rubber flap is seated snug and sealingly against sealing plastic base.; an elevated cylindrical wall forming a short tube serves as a short vacuum fitting. The vacuum fitting is not absolutely necessary and serves only as a guide for a vacuum hose, since a vacuum will naturally hold itself in place over the compartment cover without need for the vacuum fitting. The check valve is oriented so that the rubber flap faces the outside of the storage chamber, so that fluid communication between the inside space of the storage chamber and the outside of the storage chamber is only through the hole on the sealing base of the check valve. A vacuum release means is provided on the compartment cover in the form of a plastic or metal plug and hole assembly that is formed on the compartment cover or, alternatively said assembly is attached compartment vertical sidewalls. The vacuum release means can also be attached to any wall of the storage chamber. Before use, the vacuum release means is inactive and behaves a s plug, plugging fluid communication between the storage chamber and the outside. Thus, when the compartment cover is depressed by hand, or when a vacuum pump means is attached to the check valve, air can only travel out of the storage chamber as the air pressure inside the chamber pushes the rubber flap away from the check valve hole and exist the storage chamber.

Another form of the check valve is a simple flexible rubber tube that fluidly connects the inside space of the storage chamber with the outside. The tube is small and very flexible, so that when a vacuum is applied over it, air inside the storage chamber is removed and the tube walls collapse under the forces of atmospheric pressure as the pressure inside the storage chamber reduces below the atmospheric pressure.

When the compartment cover is sealed over the article compartment to form a storage chamber, the article compartment cover can be depressed manually or by means of applying a vacuum to the check valve vacuum fitting. Thus, the air is removed from the articles of travel and the storage chamber, and the compartment cover collapses around the articles of travel, and depress them into a minimum volume configuration into the storage chamber.

In a second embodiment of the present invention, the apparatus consists of a bottom receptacle and a top cover as per the first embodiment described above. The sealing technics of the first embodiment apply to the bottom receptacle and the top cover. Instead of having article compartments with vertical sidewalls, horizontal article compartments are layered in a horizontal manner, so that they are on top of each other. In this case, one or more seals are attached to various heights of the vertical sidewall of the bottom receptacle of the apparatus, so that each horizontal compartment can be either above or below the other in vertically placed order. In this case, the article compartment cover of the lower horizontal article compartment acts as the bottom wall of the horizontal article compartment above it. If there are more than two horizontal article compartments, then the horizontal article compartment cover of the horizontal article compartment above acts as the horizontal article compartment cover of the horizontal article compartment below it. All the horizontal article compartments then use the vertical sidewalls of the bottom receptacle as a common sidewall.

In the case when the apparatus takes the form of a bag or a duffle carry-on luggage, any orientation of the article compartment would be adequate, provided a matching article compartment cover is provided to seal the article compartments. In all cases, a check valve is used to maintain the vacuum state until the articles of travel need to be accessed. A vacuum release means is further provided on the compartment cover, in the form of a plug and hole that is formed on the compartment cover, or attached sealing to the compartment vertical sidewalls. The vacuum release means can also be attached to any wall of the storage chamber. When the plug is removed, the vacuum is released and the storage chamber fills with air and expands to its original configuration, and the compartment cover can be removed easily since it is no longer held in place by vacuum force. In the case when a zip is used for the locking rim, the zip can be used as a vacuum release means directly. Thus, upon opening the zip, the air enters the storage chamber and releases the vacuum from the storage chamber. Advantageously, the vacuum release means can also be incorporated on the check valve directly, so that when the rubber flap is lifted from the hole on the sealing base, the vacuum is automatically released from the storage chamber.

The present invention is an improved apparatus designed to be substantially airtight and sealable by vacuum, so that the apparatus compresses and vacuum packs articles of travel stored therein to close to the minimum possible volume allowing the maximum possible storage conditions for said articles of travel.

In yet a third embodiment of the present invention, the apparatus can be designed with a tough sealing top cover, and a tough sealing bottom receptacle in the manner described above. Thus when a vacuum is applied inside the apparatus, the apparatus top cover and bottom receptacle will be self-attaching and sealed by a vacuum force and cannot be easily opened without a special lock and key. The apparatus is designed in the same spirit as mentioned in the first and second embodiments with respect to the internal storage chambers, the vacuum sealing methods, the check valve, and the vacuum release means. The top cover is separately equipped with an additional check valve in the manner described above. If preferred, the apparatus can have its own built-in manually operated or electric vacuum pump means. Additionally, an external vacuum pump fitting could be attached to the top cover, or the bottom receptacle vertical sidewalls, so that a conventional vacuum cleaner hose attachment can be use to achieve the same effect.

The apparatus is further designed to be easily for manufactured, so that the processes that would be encountered during the manufacturing would be easily accomplished because of the way the compartment is designed. Preferably, the apparatus is designed and manufactured in the manner of conventional luggage, suitcases, carry-on bags, duffle bags, etc., with the added use of a thin airtight lining material for the purpose of making the walls of the storage chambers within the apparatus airtight. In this embodiment of the the invention, the apparatus could also be manufactured in the form of a flexible carry-on bag that has a sealable opening, so that hen a vacuum is applied to the apparatus, the entire outer walls of the apparatus collapse and self-seal the articles of travel in a secure manner.

The method of manufacture and use generally involve the broad steps of making an apparatus bottom receptacle with article compartments for storing articles of travel therein; making a top cover using conventional and known manufacturing technics; using coated fabrics that have no permeability to air; applying or forming a plastic film on the apparatus walls by either spraying said apparatus walls with a plastic sealing material or by thermally bonding a plastic material to said apparatus walls prior to manufacturing the apparatus or after manufacturing the apparatus; attaching a top cover seal to the top cover rim; applying a bottom receptacle seal to the bottom receptacle rim; said bottom receptacle seal sealingly mating with said top cover seal to the form an airtight sealed apparatus; attaching a check valve and vacuum fitting means to the either the bottom receptacle vertical sidewalls or to the top cover; attaching a vacuum release means to either top cover or to the bottom receptacle vertical sidewalls for easy access to the outside of the apparatus; attaching compartment seals on the compartments vertical sidewalls; attaching a compartment cover seal to the compartment cover; said compartment seal sealingly mating with said compartment cover seal to the form an airtight sealed storage chamber; attaching a check valve and vacuum fitting means to the either the compartment cover or to the compartment vertical sidewalls; attaching a vacuum release means to either compartment cover or to the compartment vertical sidewalls; packing said apparatus by placing articles of travel within the storage chambers; attaching the compartment cover to the article compartments by mating the seals to for an airtight storage chamber by causing said compartment seal to mate and interlock with said compartment cover seal to the form an airtight sealed storage chamber with articles of travel stored therein; evacuating said storage chambers by attaching a vacuum generating means to said check valve and vacuum fitting means; evacuate the storage chamber to remove a substantial volume of air within the storage chamber; said check valve and vacuum fitting means configured to allow air to only pass from the inside of the storage chamber to the atmosphere; said vacuum release means allowing air to rush back into the storage chamber traveling when manually activated; activating said vacuum release means to manually allow air to rush back into the storage chamber and release the vacuum hold of the apparatus compartment cover and the article compartment to access the articles of travel.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
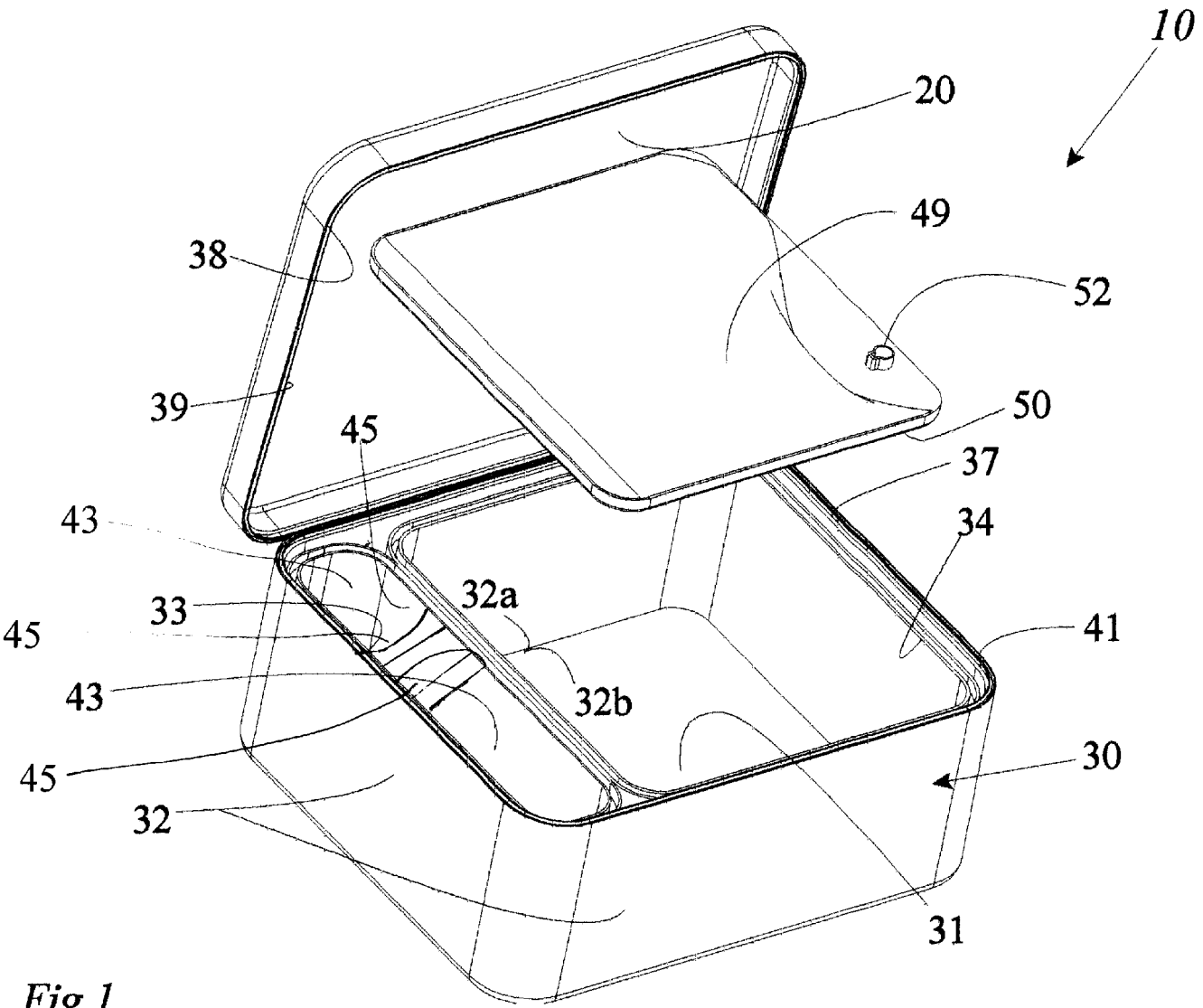
FIG. 1 is a drawing showing the apparatus according to one embodiment of the present invention with some compartments shown on the bottom receptacle and a sealing compartment cover ready for placement over a compartment.
Figure 2:
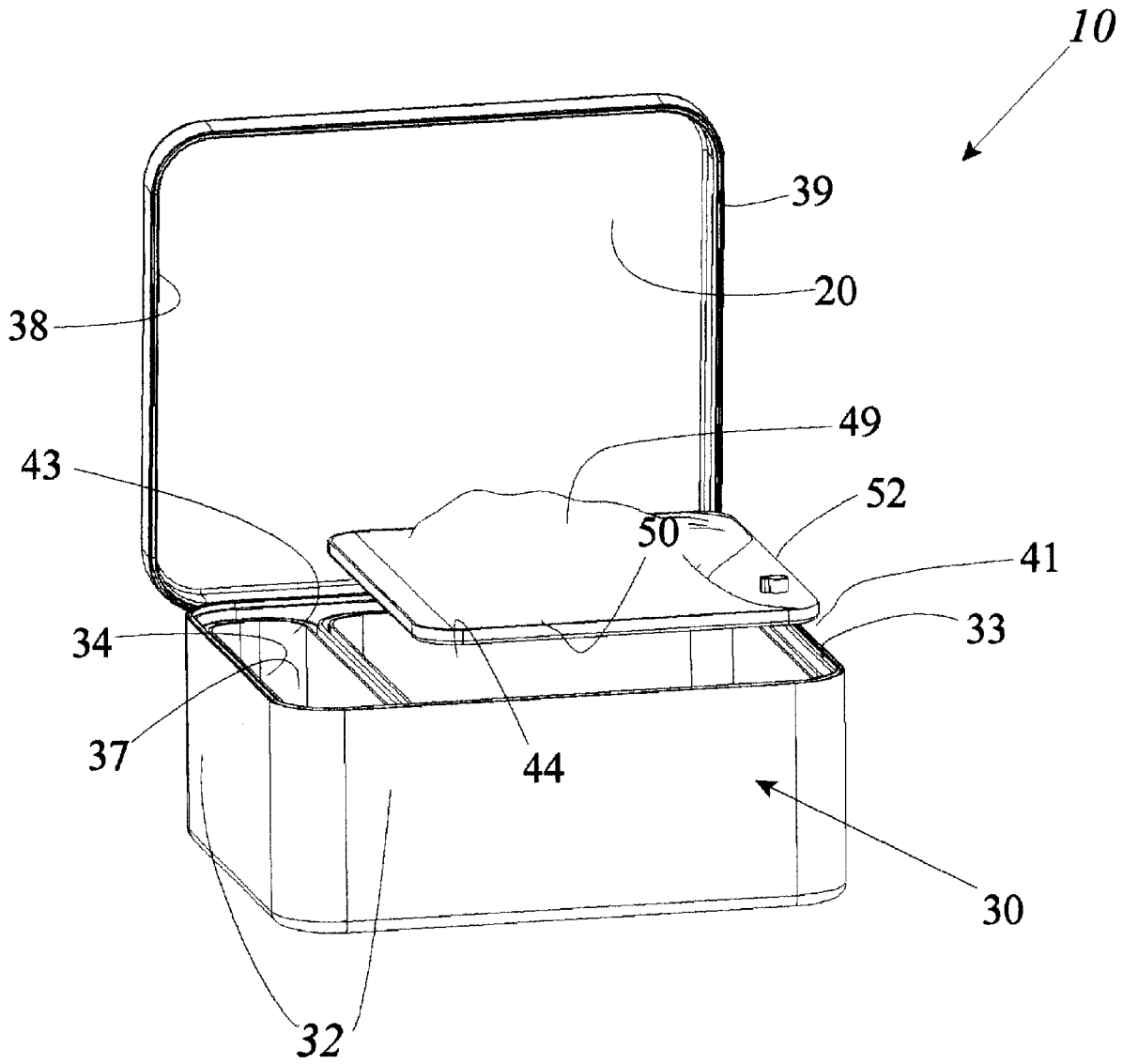
FIG. 2 shows some other details of the apparatus according to the first embodiment of the present invention.
Figure 3:
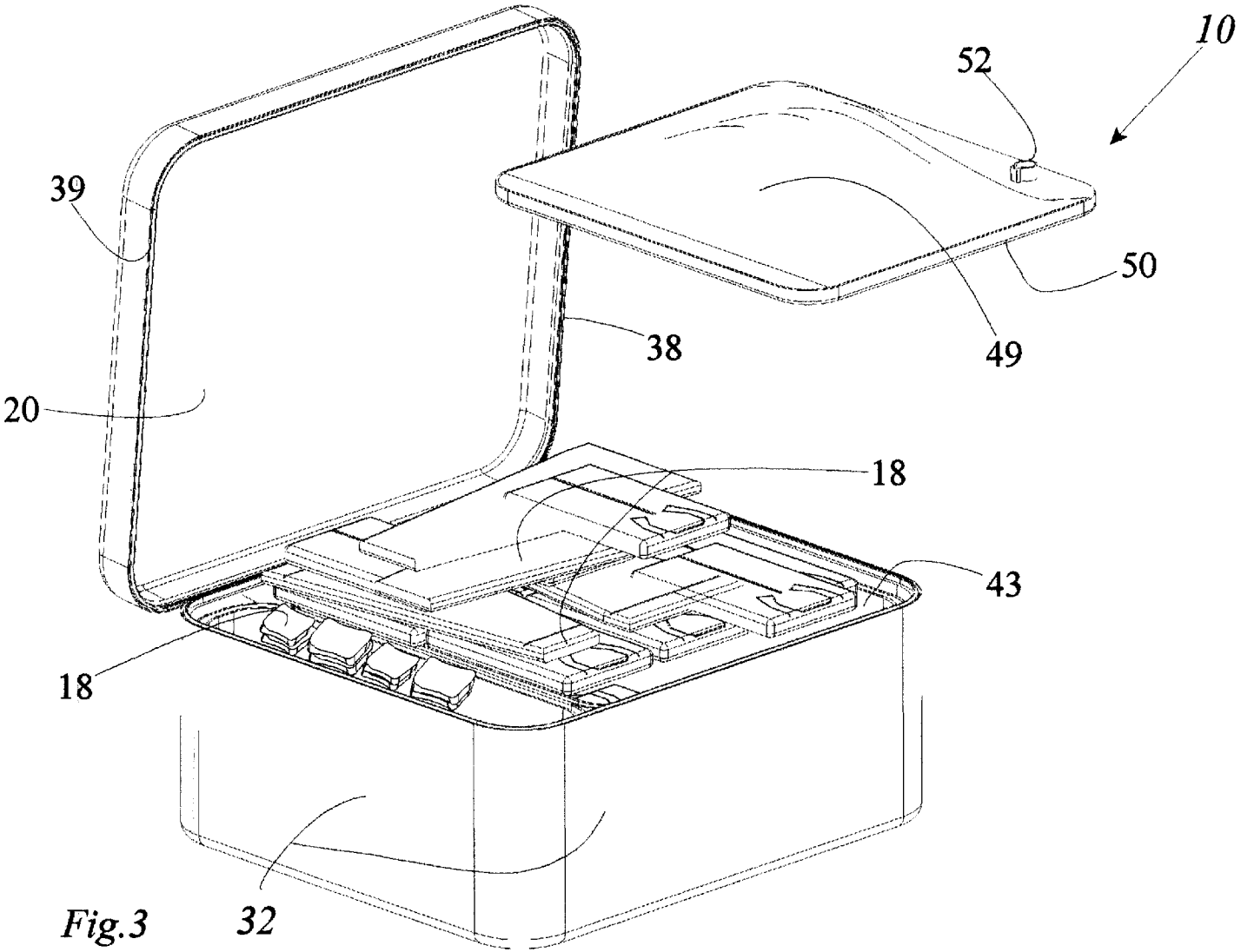
FIG. 3 is a drawing showing the apparatus according to the first embodiment of the present invention with some compartments filled with articles of travel, and a sealing compartment cover ready for placement over a compartment.
Figure 4:
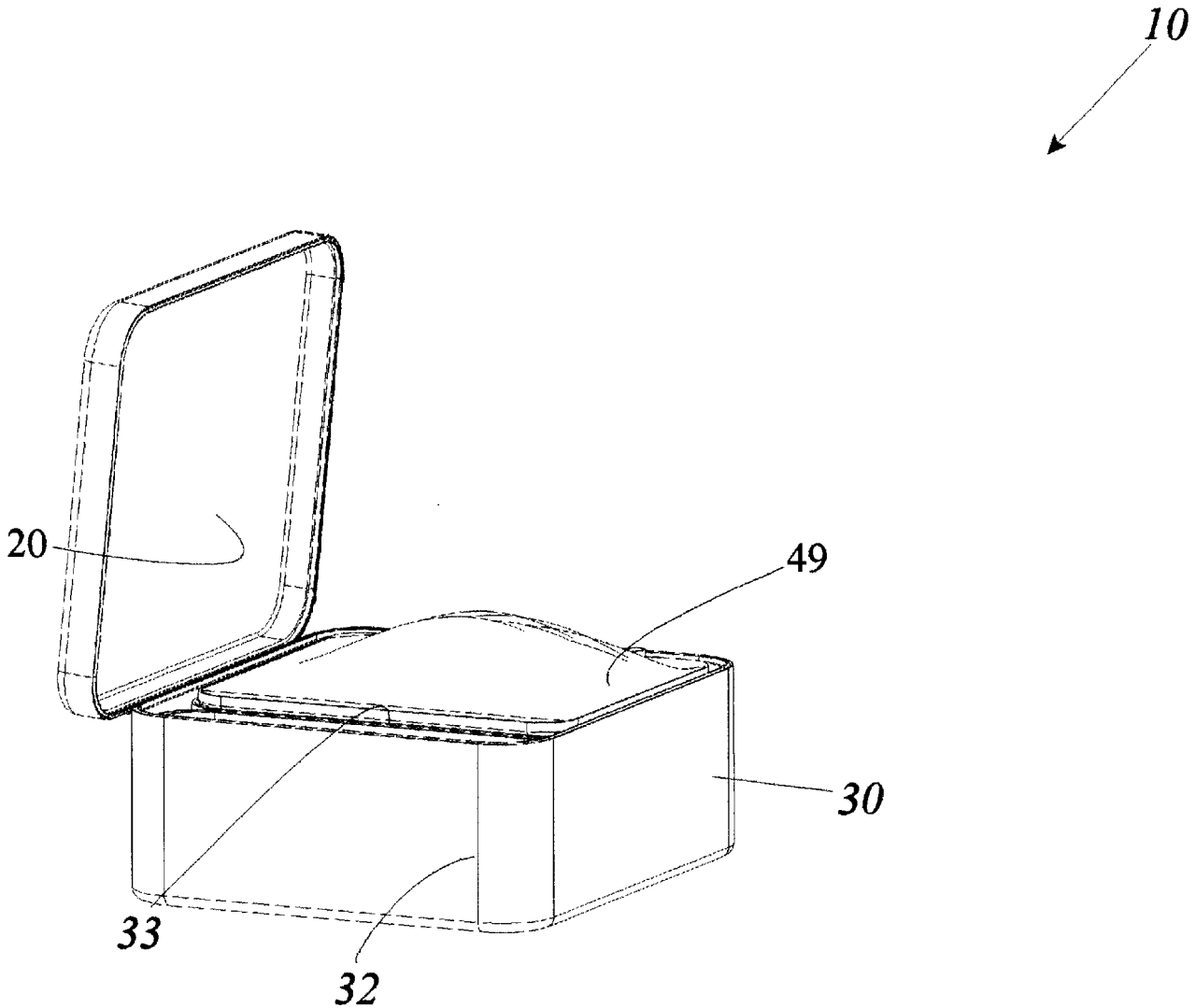
FIG. 4 is a drawing showing the apparatus according to the first embodiment of the present invention with a sealing cover sealed over a compartment filled with articles of travel.
Figure 5:
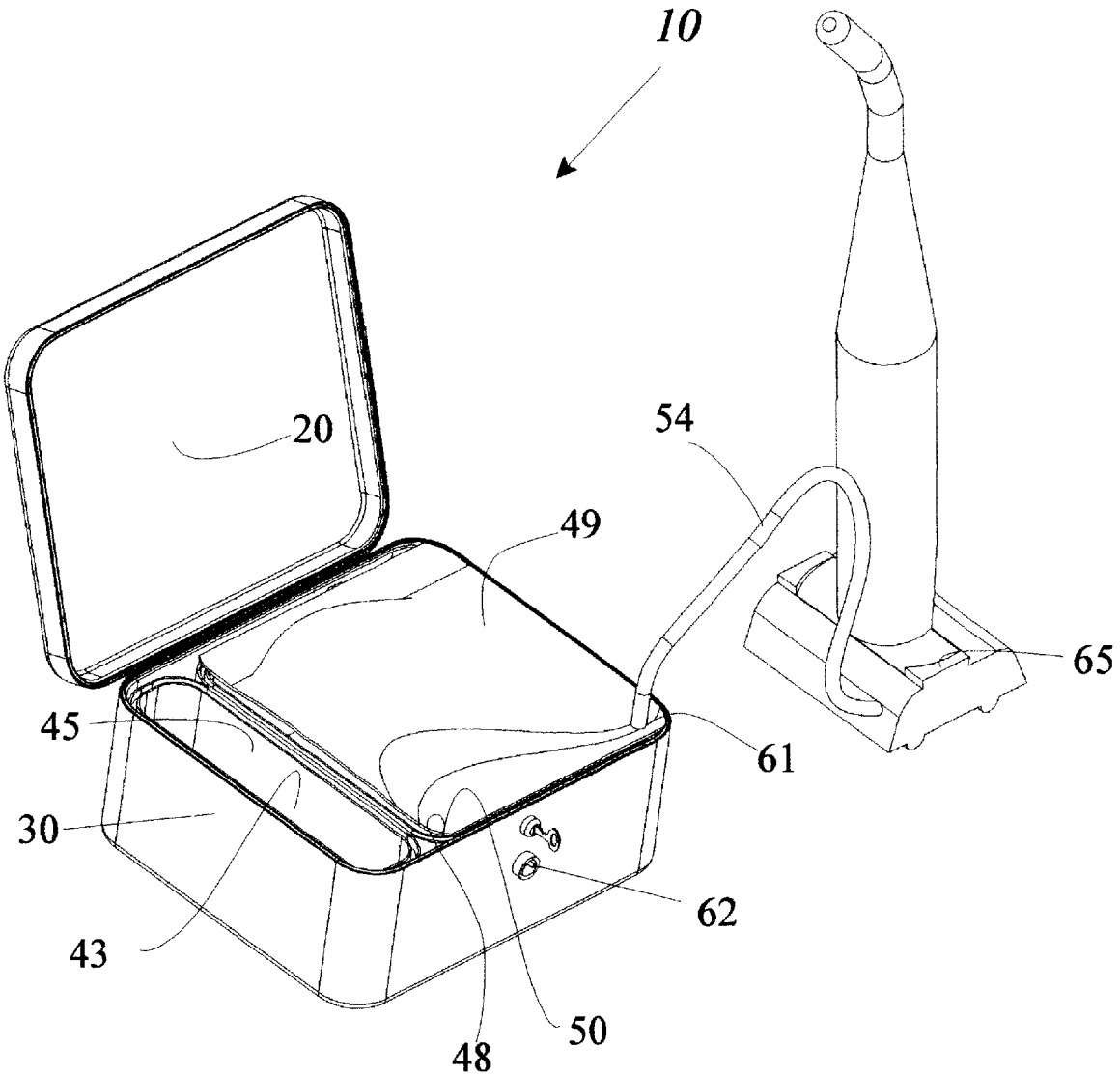
FIG. 5 is a drawing showing the apparatus according to the first embodiment of the present invention with a sealing cover sealed over a compartment filled with articles of travel and a vacuum pump means being used to evacuate a sealed compartment of the apparatus.
Figure 6:
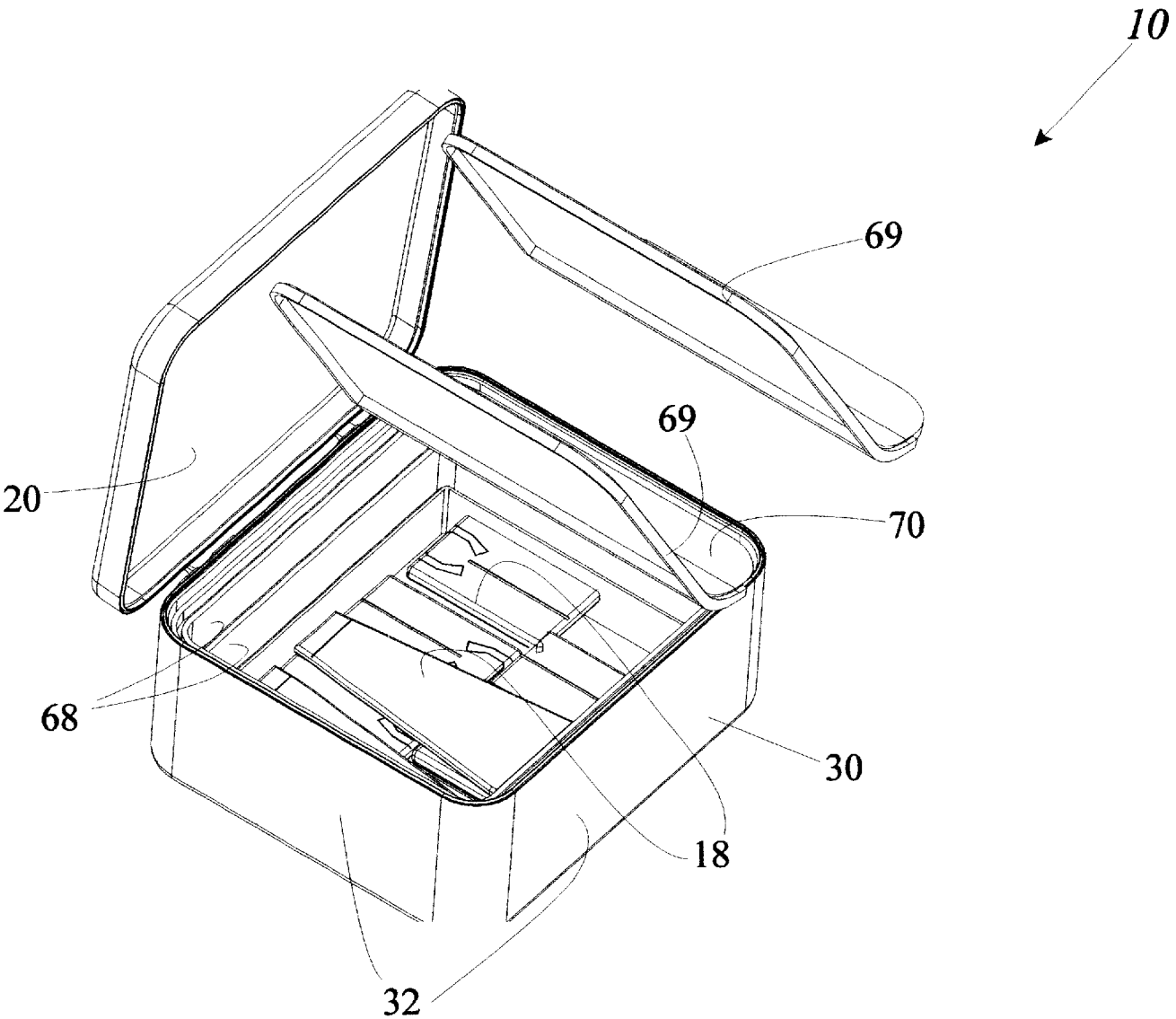
FIG. 6 is a drawing showing the apparatus according to another embodiment of the present invention with some horizontal compartments shown on the bottom receptacle and sealing horizontal compartment covers ready for placement over horizontal compartments.
Figure 7:
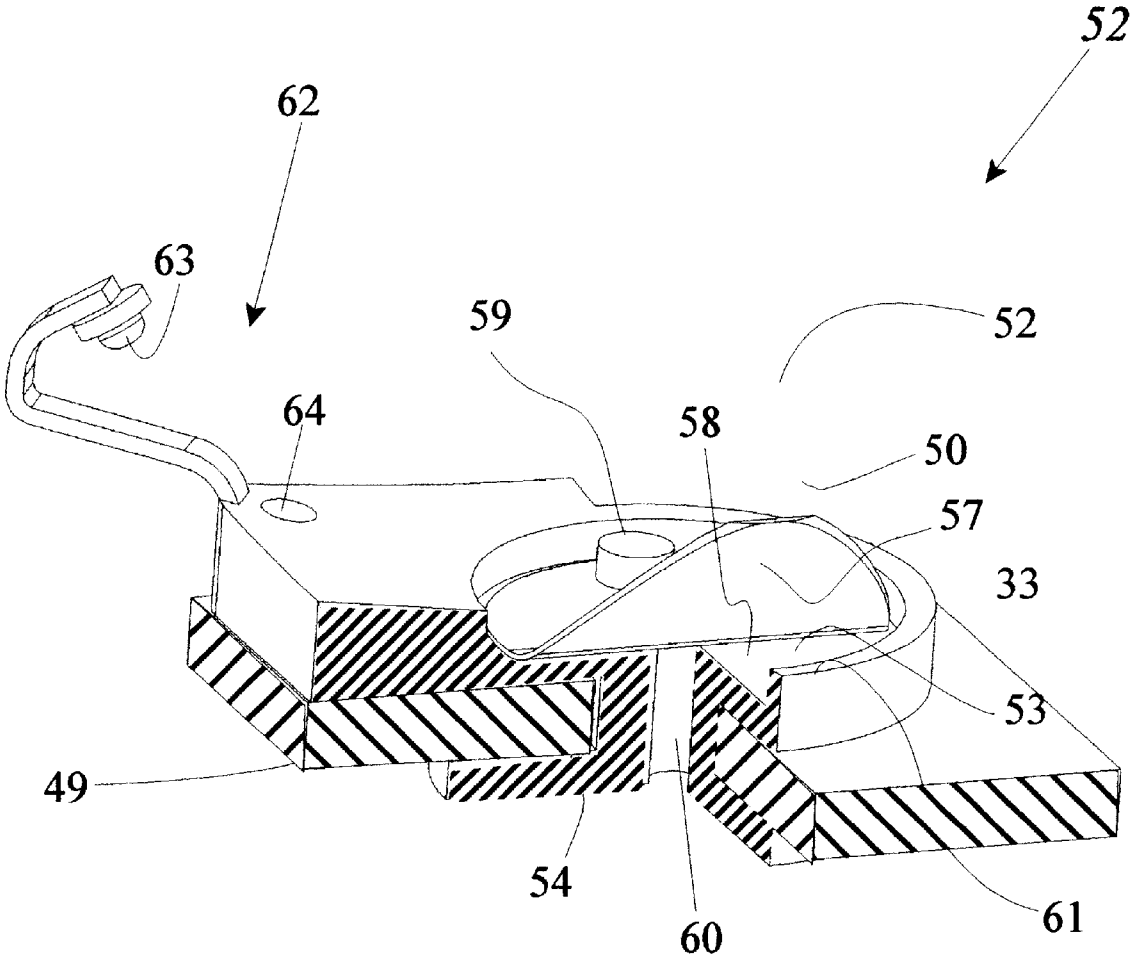
FIG. 7 shows details of one type of check valve that could be used with some embodiments of the apparatus.
Figure 8:
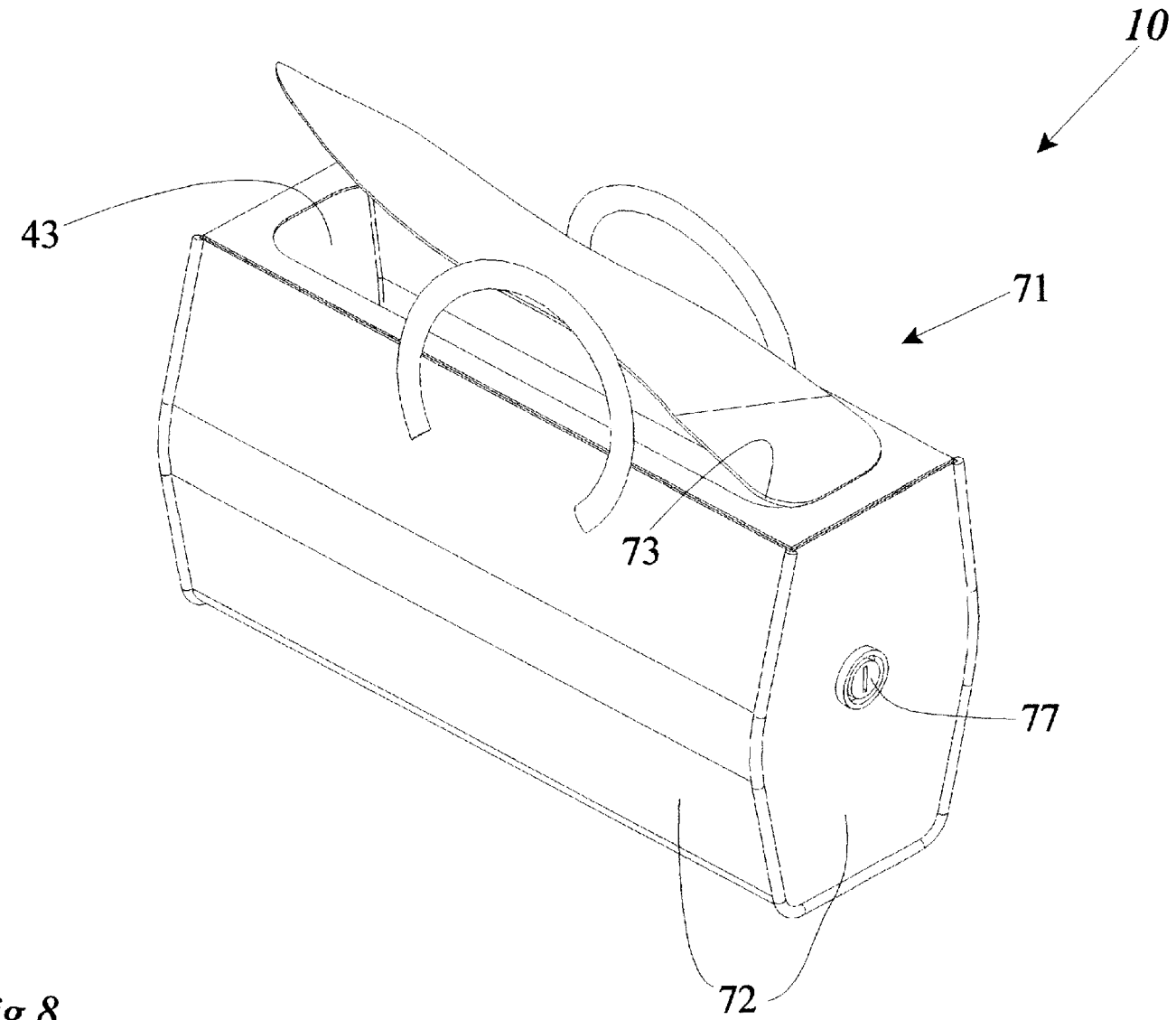
FIG. 8 is a drawing showing the apparatus according to another embodiment of the present invention in the form of a bag, or a carry-on luggage with sealing rims, a check valve and a vacuum fitting installed on one sidewall.
Figure 9:
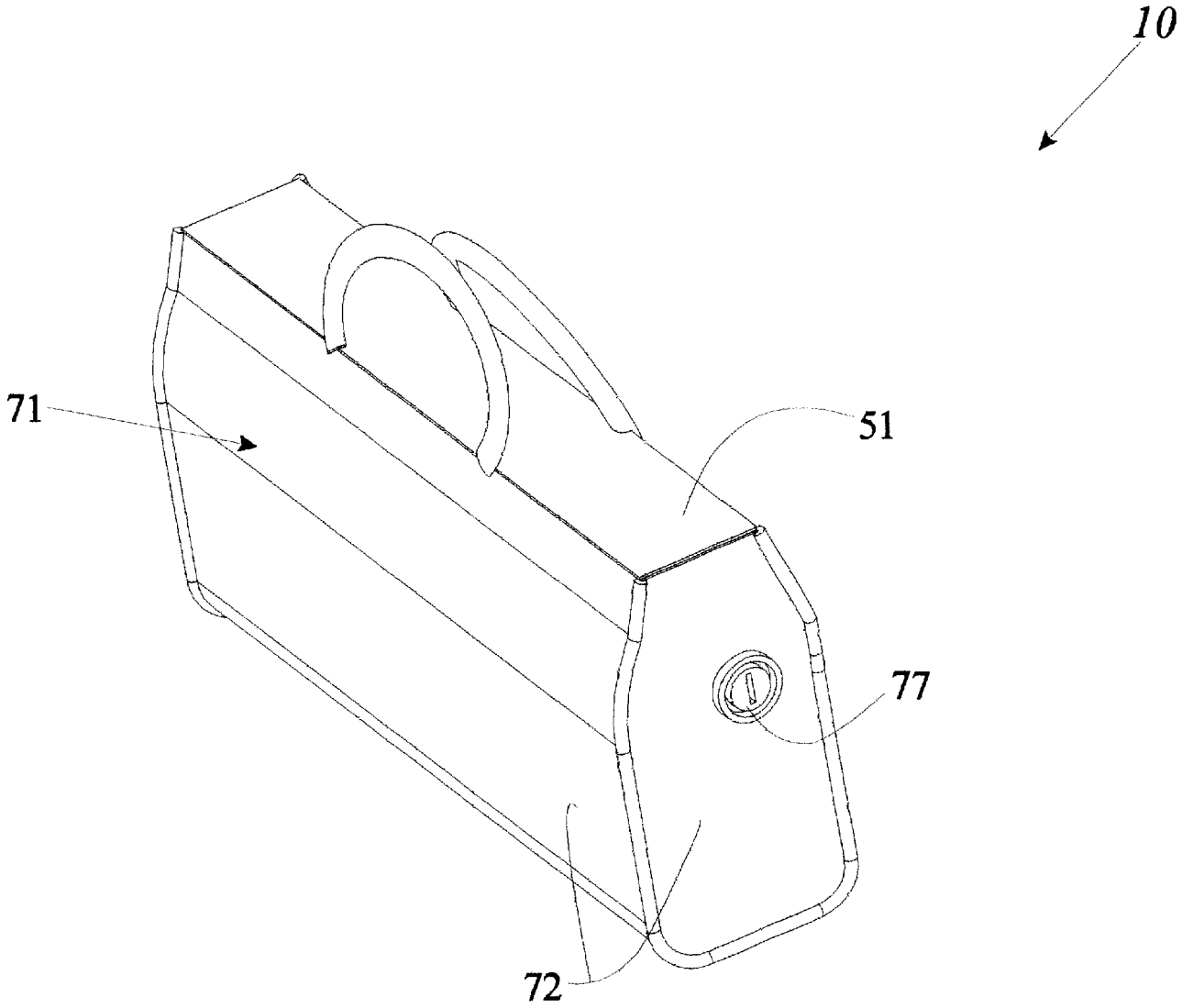
FIG. 9 shows the apparatus according to the embodiment of FIG. 8 in the form of a bag, or a carry-on luggage, in an evacuated sealed state after application of a vacuum.
Figure 10:
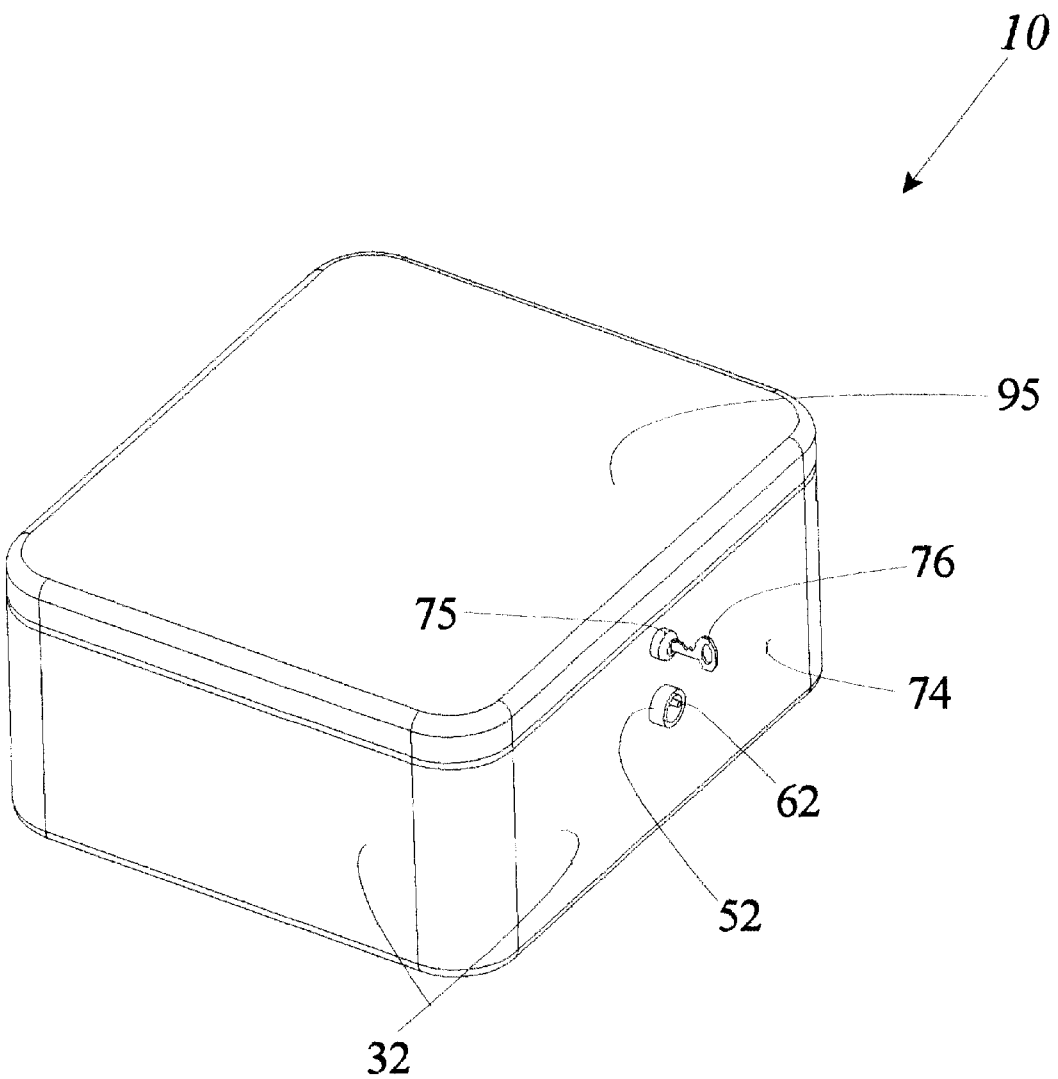
FIG. 10 shows the apparatus according to another embodiment of the present invention with a hard top sealing cover sealed over a bottom receptacle to form an airtight sealed and locked apparatus. A vacuum lock and key is shown to open and lock the apparatus using the force of a vacuum acting on the large area walls of the apparatus during and after use.
Figure 11:
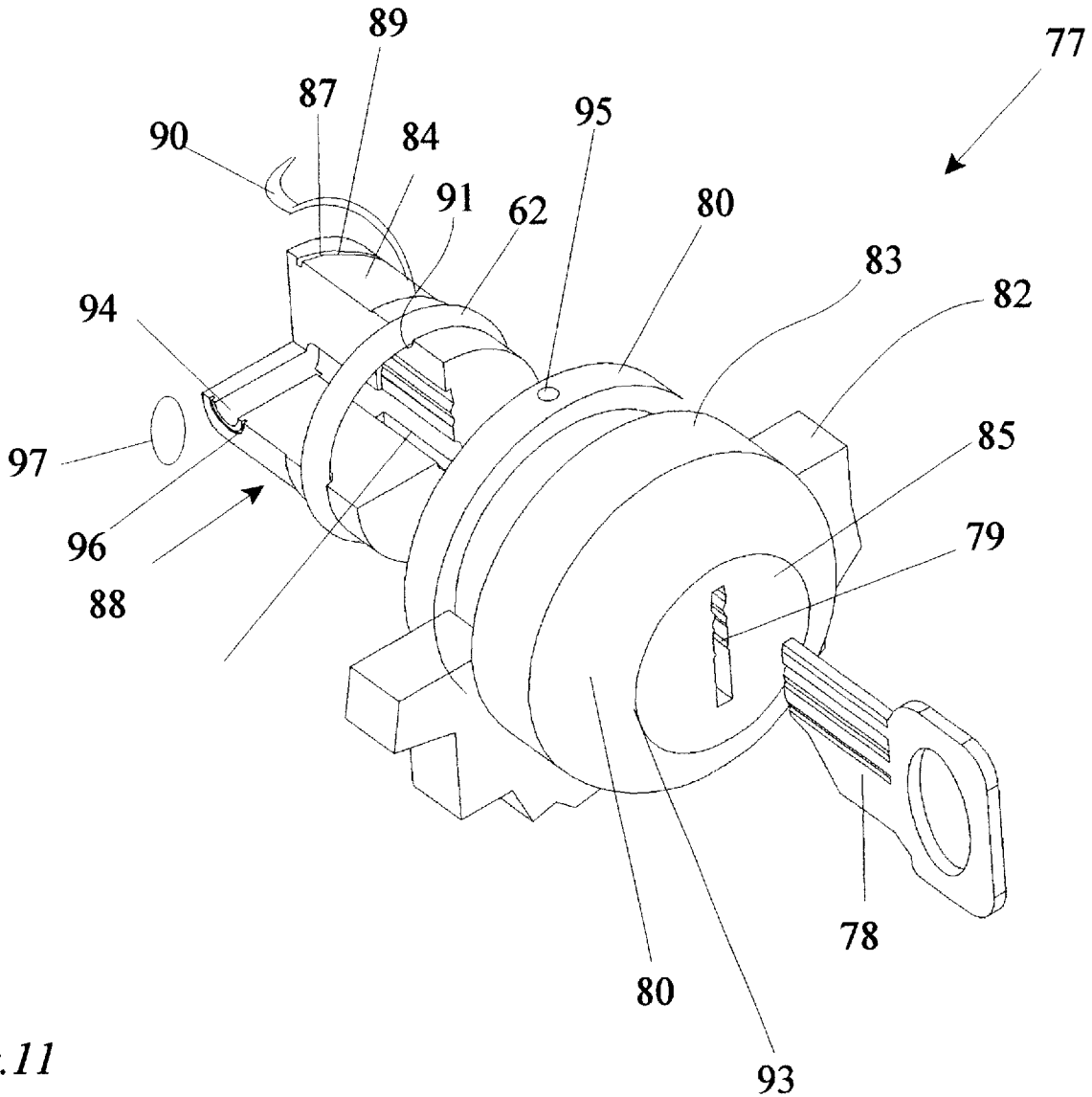
FIG. 11 shows the details of one embodiment of the vacuum lock and key system.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Embodiment of the Invention

When oriented in the position of normal use, the apparatus 10 includes bottom receptacle 30 having a horizontal and contiguous rigid or flexible bottom wall 31 that is sealing connected at the bottom edge 32*a* to the bottom edge 32*b* of bottom receptacle vertical sidewalls 33. The bottom receptacle vertical sidewalls 33 may be made of rigid or flexible material, but the materials of construction must be make them airtight. The material of construction of the apparatus 10 is either clothing, leather, wood, metal or plastic. If made from material that is permeable or porous to air, such as clothing or leather, the material must be lined with a plastic material in the form of a film 34 so as to make all the walls of apparatus 10 airtight and impervious to air flow. The film 34 is attached to the bottom receptacle vertical sidewalls 33 and the bottom wall 31 by thermal bonding, gluing or spraying and thus, may be either loosely attached, or formed as part of the structure of the fabric of the walls of the apparatus 10. Apparatus 10 can also be formed from injection molded or vacuum formed plastic material also. The bottom receptacle vertical sidewalls 33 terminate in a continuous open top-rim 33 that is substantially rectangular but could take on any desired shape or size. A hinge 35 attaches top cover 20 to a corresponding and matching bottom receptacle vertical sidewalls 33 of bottom receptacle 30. On the top-rim 33 of vertical sidewall 32 is attached a continuous plastic or rubber bottom receptacle seal 37 that can be sealingly mated with a corresponding top cover seal 38 on the rim of the top-cover. The top cover seal 38 preferably has a female groove 39 for a cross-section and attaches sealingly to a bottom receptacle seal 37 which has a male tongue 41 for a cross-section. When the top cover seal 38 is mated and sealingly attached to the bottom receptacle seal 37, the apparatus 10 becomes airtight. The hinges are designed not to interfere with the sealing of the top cover 20 and the bottom receptacle 30.

In the case when the apparatus 10 is a simple duffle bag with no particular structure to the bottom receptacle vertical sidewalls 33, the top cover seal 38 of the apparatus 10 is simply designed as part of the open top rim 36 and can be made to interlock, mate and seal with each other, or with a separate top-cover. Thus, in such a case, the bottom receptacle vertical sidewalls 33 will be flexible.

In all cases, apparatus 10 consists of walls that sealingly connect to form a contiguous enclosed space that is airtight. It is however not necessary that the top-cover 20 and the bottom receptacle 30 form an airtight apparatus in most cases but not in all cases. This will be explained further in the following paragraphs.

In the first preferred embodiment of the invention, apparatus 10 takes the form of a travel luggage with four bottom receptacle vertical sidewalls 33 that sealingly connect to a bottom wall 31 to form a bottom receptacle 30. The bottom receptacle 30 preferably has one or more separate article compartments 43 that are made by dividing the inside space 44 of bottom receptacle 30 with an arrangement of compartment vertical side walls protruding from the bottom wall 31 of the bottom receptacle 30. These article compartments 43 are used by a traveler for organizing articles of travel 18 including clothes, toiletry and other items needed during travel and after reaching a destination.

Each article compartment is separated from the other by a compartment vertical sidewalls 45 sealingly connected to the bottom wall 31 of the bottom receptacle 30. The compartment vertical sidewalls 45 will generally be slightly lower that the bottom receptacle seal 37. The top rim 36 of each article compartment 43 has a separate continuous plastic or rubber compartment seal 54 that sealingly mates with a compartment cover 49 by means of a compartment cover seal 50. Thus, the apparatus 10 may or may not have an overall outer sealed structure, with internal compartments each of which can be sealed airtight and separately by an internal compartment cover 49. The compartment cover seal 50 is preferably a female groove 39 in cross-section that attaches and fits over a mating male tongue 41 cross-sectioned compartment seal 48. The compartment cover seal 50 and the compartment seal 48 could also be designed as an airtight plastic zipper, so that conventional sealing and airtight attachment means could also be used in each case where needed. Other methods of sealing could be used, but they all achieve the same purpose and would accomplish the same result. When the compartment cover seal 50 is sealingly attached to the compartment seal 48 a storage chamber 51 is formed that is airtight. Thus, there may be several of storage chamber 51, or just one large internal storage chamber 51.

A check valve 52 is attached sealingly to each compartment cover 49, so that when the compartment seal 48 is sealed over the compartment cover seal 50, fluid communication between the inside space of the storage chamber 51 and the outside of the storage chamber 51 thus formed is only through the said check valve 52. The check valve 52 can be a conventional off-the shelf check valve 52 of known technology. In its simplest form, the check valve 52 comprises a sealing plastic base 53 that sealingly attaches to the compartment vertical walls through a hole on the compartment cover 49. The check valve 52 could also be advantageously attached to portions of the bottom receptacle vertical sidewalls 33 to fluidly connect with each storage chamber 51. The sealing base 53 of the check valve 52 is a recessed flat surface 58 with a slight depression to hold a flat and thin rubber flap 57 in place. The rubber flap 57 is attached to the flat surface 58 by a rivet or simply by a snap-on attachment 59. Preferably the rubber flap 57 seats snugly and sealingly against the flat surface 58 of the check valve 52. A hole 60 runs through the sealing base 53, and the rubber flap 57 is placed to seal over said hole 60 against the flat surface 58 of the sealing base 53; an elevated rim of the check valve 52 forms a short vacuum fitting 61for attaching a vacuum hose. The vacuum fitting 61 is not absolutely necessary and serves only as a guide for a vacuum hose, since a vacuum will naturally hold itself in place over the compartment cover 49 without need for the vacuum fitting 61. The check valve 52 is oriented so that the rubber flap 57 faces the outside of the storage chamber 51, so that fluid communication between the inside space of the storage chamber 51 and the outside of the said storage chamber 51 is only through the hole 60 on the sealing base 53 of the check valve 52. A vacuum release means 62 is further provided on the compartment cover 49, or as in the case of the check valve 52 on a connecting vertical sidewall 33 of the bottom receptacle 30 to said storage chamber 51. The vacuum release means 62 is in the form of a plug 63 and hole 64. Before use, the vacuum release means 62 is inactive sealed off and is thus hole 64 is plugged by the plug 63, plugging fluid communication between the storage chamber 51 and the outside. Thus, when the compartment cover 49 is depressed by hand, or when a vacuum pump means 65 is attached to the check valve 52, air can only travel out of the storage chamber 51 to the outside as the air pressure inside the storage chamber 51 increases above atmospheric pressure and pushes the rubber flap 57 away from the hole 60 on the check valve 52, causing air in the storage chamber 51 to exit the storage chamber 51. Hand pressure on the compartment cover 49 is sometimes enough to evacuate the storage chamber 51. However, a vacuum pump means 65 could also be used to achieve a better effect of evacuating the storage chamber 51 and compressing the articles of travel 18 to a minimum possible volume.

Another form of the check valve 52 is simply a flexible tube 66 that fluidly connects the inside space of the storage chamber 51 with the outside. The tube 66 is small and very flexible, so that when a vacuum is applied over it, air inside the storage chamber 51 is removed and the tube 66 collapses under forces of atmospheric pressure as the pressure inside the storage chamber 51 reduces below the atmospheric pressure, causing the wall 67 of the tube 66 to self-seal.

When the compartment cover 49 is sealed over the article compartment to form a storage chamber 51, the compartment cover 49 can be depressed manually or by means of a vacuum pump through the check valve 52 vacuum fitting. Thus, the air is removed from the articles of travel 18 and the storage chamber 51, and the compartment cover 49 collapses around the articles of travel 18, and depress them into a minimum volume configuration.

Second Embodiment of the Invention

In a second embodiment of the present invention, the apparatus 10 consists of a bottom receptacle 30 and a top cover 20 as per the first embodiment described above. The sealing technics of the first embodiment applies to the bottom receptacle 30 and the top cover 20. Instead of having small storage compartments inside the bottom receptacle 30, horizontal article compartments 68 are layered in a horizontal manner, so that they are on top of each other. In this case, one or more seals are attached to various heights of the vertical sidewall 32 of the bottom receptacle 30 of the apparatus 10, so that each horizontal article compartment 68 can be either above or below the other in vertically spaced location. In this case, the horizontal article compartment sealing cover 69 of the lower horizontal article compartment 68 acts as the bottom wall 70 of the horizontal article compartment 68 above it. If there are more than two horizontal article compartments 68, then the horizontal article compartment sealing cover 69 of the horizontal article compartment 68 above acts as the horizontal article compartment sealing cover 69 of the horizontal article compartment 68 below it. All the horizontal article compartments 68 then use the vertical sidewall 32 of the bottom receptacle 30 as a common vertical sidewall 32.

Third Embodiment of the Invention

In a third embodiment of the present invention, the apparatus 10 takes the form of a bag or a duffle carry-on luggage 71. Any orientation of the article compartments 43 would be adequate. In this case however, the article compartments 43 may comprise just two bag sidewalls 72 that have matching sidewall compartment seals 73 to seal the article compartments 43 and form storage chamber 51. In all cases, the check valve 52 is used to maintain the vacuum state until the articles of travel 18 need to be accessed. Thus, by sealingly attaching the bag sidewalls 72 of the article compartments 43 together, a storage chamber 51 is formed inside the apparatus 10.

A vacuum release means 62 is further provided on each storage chamber 51. The vacuum release means 62 can also be attached to any bag sidewall 72 of the storage chamber 51. Thus when a vacuum is applied to the storage chamber 51, the bag sidewalls 72 simply collapse and compress the articles of travel 18 to a minimum possible volume. When the plug 63 is removed, the vacuum is released and the article compartment 43 fills with air again in its expanded configuration, and the storage chamber 51 can then be easily opened, since the bag sidewalls 72 are no longer held together by vacuum force. In the case when a zip is used for the sealing of the storage chamber 51, the zip can be used as a vacuum release means 62 directly. Thus, upon opening the zip, the air enters the storage chamber 51 and releases the vacuum in storage chamber 51.

The present invention is an improved apparatus 10 designed to be substantially airtight and sealable by vacuum, so that the apparatus 10 compresses and vacuum packs articles of travel 18 stored therein to close to the minimum possible volume allowing the maximum possible storage conditions for said articles of travel 18.

Fourth Embodiment of the Invention

In yet a fourth embodiment of the present invention, the apparatus 10 can be designed with a tough sealing top cover 73, and a tough sealing bottom receptacle 74 in the manner described above. Thus when a vacuum is applied inside the apparatus 10, the apparatus 10 through sealing top cover 73 and sealing bottom receptacle 74 will be self-attaching and sealed by a vacuum force and cannot be easily opened without a special lock 75 and key 76. The apparatus 10 is designed in the same spirit as mentioned in the first and second embodiments with respect to the storage chamber 51, the vacuum sealing methods, the check valve 52, and the vacuum release means 62. The sealing top cover 73 is equipped with an additional separate check valve 52, in the manner described above. If preferred the apparatus 10 can have its own built-in manually operated or electric vacuum pump means 65. Additionally, an external vacuum pump fitting 61could be attached to the sealing top cover 73, or the bottom receptacle vertical sidewalls wall 33, so that a conventional vacuum cleaner hose attachment can be use to achieve the same effect.

A vacuum key and lock system 77 is provided on the sealing top cover 73 or on the bottom receptacle vertical sidewalls wall 33 of the apparatus 10. A vacuum release means 62 is also provided. The vacuum key and lock system 77 comprises a key 78 that is cut to a certain profile that matches a keyhole 79 on a valve cylinder 84 of the vacuum key and lock system 77. The profile of the key 78 has a unique contour, so that no two keys are alike. The vacuum lock system 77 further comprises an annular lock cylinder 80 with a cylindrical lock cylinder hole 81that is sealingly attached to one wall 82 of the bottom receptacle 30 or to the sealing top cover 73 with a lock cylinder flange 83. A valve cylinder 84 is provided in the form of a solid cylinder with a round valve cylinder flange 85 and said valve cylinder 84 slidingly fits into the lock cylinder hole 81. The valve cylinder flange 85 mates slidingly with the frontal face of the lock cylinder flange 83, so that sails valve cylinder 84 cannot go through the lock cylinder hole 81. The valve cylinder 84 extends beyond the back edge of the lock cylinder 80; a groove 87 on the extended part 88 of the valve cylinder 84 serves as a seat 89 for a spring clip 90, so that when said spring clip 90 is in place on the valve cylinder 84, the valve cylinder 84 becomes trapped in the lock cylinder 80, and cannot be removed. An o-ring groove 91 is provided on the part of the valve cylinder 84 inside the lock cylinder hole 81, to hold an o-ring 92 that acts as a seal for the gap 93 between the valve cylinder 84 and the lock cylinder 80. A valve cylinder cross-hole 94 on the valve cylinder 84 matches with a lock cylinder cross-hole 95 on the lock cylinder 80, to fluidly connect the inside space of the apparatus 10 with the keyhole on the valve cylinder, so that when the two holes align, air can pass as needed through the keyhole 79 into the apparatus 10 when so required. A rubber seal 97 is seated on an o-ring groove 96 surrounding the valve cylinder cross-hole 94 to seal around it against the wall of lock cylinder hole 95 when the two are off-alignment.

To use the vacuum key and lock system 77, the key 78 is inserted into keyhole 79, and the used to rotate the valve cylinder 84, and seal off the valve cylinder cross-hole 94, by un-aligning it to the lock cylinder cross-hole 95. The apparatus 10 is filled with articles of travel 18, and each article compartment 43 is sealed off with a compartment cover 49. The storage chamber 51 is evacuated as described earlier to compress and minimize the volume of the articles of travel 18 and the storage chamber 51. The sealing top cover 73 is then sealed over the sealing bottom receptacle seal 40 to form an air tight apparatus 10. The vacuum is then applied by either an internally built vacuum pump on the apparatus 10, or by an external vacuum source. The pressure of the atmosphere holds the sealing top cover 73 and the sealing bottom receptacle 74 in a sealed state to form a secure and sealed apparatus 10. To access the apparatus 10, the key 77 is inserted into the keyhole 79 and the used to rotate the valve cylinder 84, and align the valve cylinder cross hole 94 with the lock cylinder cross-hole 95. Air enters the apparatus 10 through the keyhole 79 and releases the vacuum hold on the sealing top cover 73 and the sealing bottom receptacle 74. The sealing top cover 73 can then be easily opened for access to articles of travel 18.

Preferred Manufacturing Process

The apparatus 10 is further designed to be easily for manufactured, so that the processes that would be encountered during the manufacturing would be easily accomplished because of the way the article compartments 43 are designed. Preferably, the apparatus 10 is designed and manufactured in the manner of conventional luggage, suitcases, carry-on bags, duffle bags, etc., with the added use of a thin airtight lining material in the form of a sealing film 34 for the purpose of making the walls of the storage chamber 51 within the apparatus 10 airtight.

The method of manufacture and use generally involve the broad steps of making an apparatus 10 bottom receptacle 30 with article compartments 43 for storing articles of travel 18 therein; making a top cover 20 using conventional and known manufacturing technics; using coated fabrics that have no permeability to air; applying or forming a plastic film 34 on the apparatus 10 walls by either spraying the walls of the apparatus 10 walls with a plastic sealing material or by thermally bonding a plastic material to said apparatus 10 walls prior to manufacturing the apparatus 10 or after manufacturing the apparatus 10; attaching a top cover seal 38 to the top cover rim 36; applying a bottom receptacle seal 37 to the bottom receptacle open bottom receptacle rim 42; said bottom receptacle seal 37 sealingly mating with said top cover seal 38 to the form an airtight sealed apparatus 10; attaching a check valve 52 and vacuum fitting 61 to the either the bottom receptacle vertical sidewalls 33 or to the top cover 20; attaching a vacuum release means 62 to either top cover 20 or to the bottom receptacle vertical sidewalls 33 for easy access to the outside of the apparatus 10; attaching a compartment seal 48 on the compartment vertical sidewalls 45; attaching a compartment cover seal 50 to the compartment cover 49; said compartment seal 48 sealingly mating with said compartment cover seal 50 to the form an airtight sealed storage chamber 51; attaching a check valve 52 and vacuum fitting 61 to the either the compartment cover 49 or to the compartment vertical sidewalls 45; attaching a vacuum release means 62 to either compartment cover 49 or to the compartment vertical sidewalls 45; packing said apparatus 10 by placing articles of travel 18 within the storage chamber 51; attaching the compartment cover 49 to the article compartments 43 by mating the seals to form an airtight storage chamber 51 by causing said compartment seal 48 to mate and interlock with said compartment cover seal 50 to the form an airtight sealed storage chamber 51 with articles of travel 18 stored therein; evacuating said storage chamber 51 by attaching a vacuum pump means 65 to said check valve 52 and vacuum fitting 61; evacuate the storage chamber 51 to remove a substantial volume of air within the storage chamber 51; said check valve 52 and vacuum fitting 61 configured to allow air to only pass from the inside of the storage chamber 51 to the atmosphere; said vacuum release means 62 allowing air to rush back into the storage chamber 51 when manually activated; activating said vacuum release means 62 to manually allow air to rush back into the storage chamber 51 and release the vacuum hold of the apparatus 10 compartment cover 49 and the article compartments 43 to access the articles of travel 18.

Figure 12:
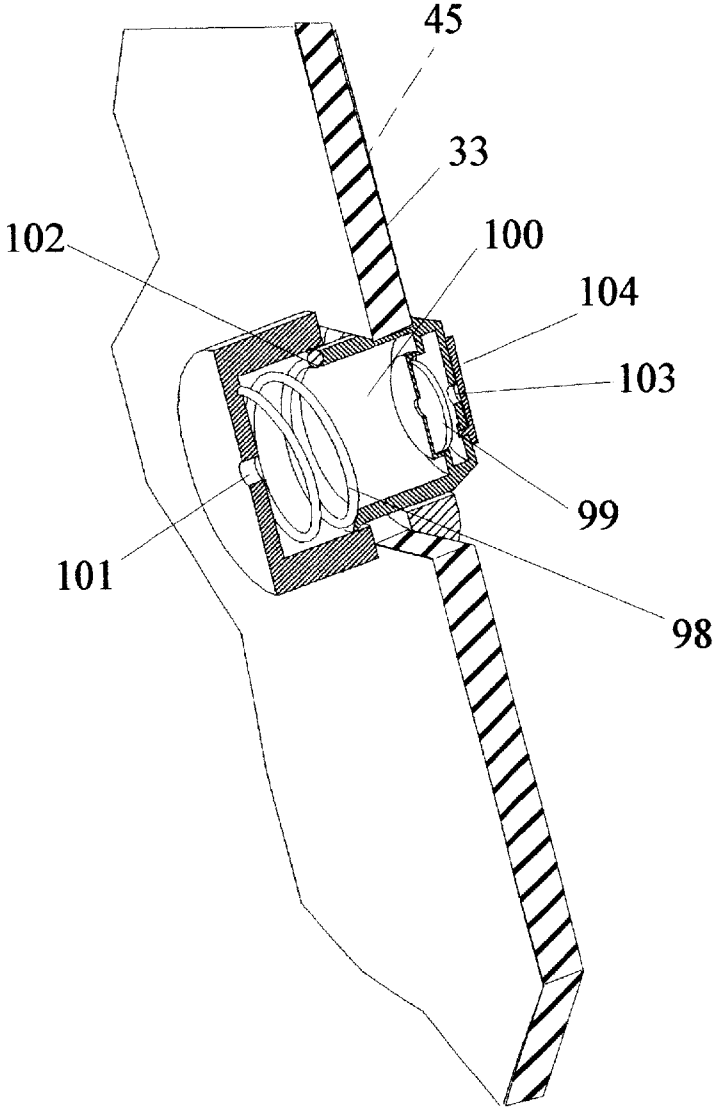
FIG. 12 shows details of one embodiment of a built in hand operated vacuum pump that could be installed on the walls of the apparatus.

In all the embodiments, the vacuum pump means 65 may also be incorporated in the form of an attached manually powered vacuum pump as shown in FIG. 12. In FIG. 12, a pump plunger 97 is held inside a pump cylinder 100 that attaches sealingly to the bottom receptacle vertical sidewalls 33 or to the compartment vertical sidewalls 45 (sections of both walls are schematically represented by the same diagram). Pump plunger 97 forms a seal with the pump cylinder 100 by means of a circumferential seal 102. A rubber flap 99 serves as a one way valve for the air to bleed 101 to bleed air through the air bleed hole 103 from within the apparatus 10 into the pump cylinder 100, then to the outside, through air exit hole 103. A spring 98, forces the plunger 97 to remain at rest at the top position as shown in FIG. 12. When the plunger 97 is manually depressed, rubber flap 99 forms a seal with the base of pump cylinder 100 and plugs air bleed hole 101. Air within the pump cylinder 100 is thus pushed outside the pump through air exit hole 103, raising the rubber flap 104 as it exits. When the plunger 97 is released to return back to the rest state as shown in FIG. 12, the spring forces plunger 97 back upwards, and the rubber flap 104 seals because a vacuum is formed within the pump cylinder 100. The vacuum forces rubber flap 99 to open up as air from within the apparatus 10 rushed to fill the pump cylinder 100, lowering the internal pressure of apparatus 10. After the air within the pump cylinder 100 has equilibrated with the internal pressure of the apparatus 10, rubber flap 99 falls back to seal off the air bleed hole 101, and the vacuum pump means 65 is ready for the next cycle of air removal and evacuation of apparatus 10. Thus, advantageously, each storage chamber 51 of the apparatus 10 could be evacuated using this simple built in device.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A luggage item consisting of an airtight bottom receptacle component and a substantially matching airtight top cover component; each said component having a generally oblong rectangular configuration, each said configuration having a bottom surface, a top surface, a rear surface, a front surface, and two opposing side surfaces respectively; and, on the bottom receptacle component there are provided a plurality of vertical compartment sidewalls; said vertical compartment sidewalls sealingly connected to said bottom receptacle component bottom surface to define a plurality of internal compartments therein for storage of articles of travel; each said internal compartment having a separate and continuous sealing rim; at least one flexible airtight sealing cover, each said sealing cover having a collapsible surface area bounded by a sealing edge that mates sealingly to a correspondingly matched internal compartment sealing rim to form an airtight storage chamber of variable volume; a check valve means sealingly attached to said sealing cover to allow air to only freely pass from said storage chamber to the atmosphere; a vacuum fitting sealingly attached to said sealing cover so that a vacuum pump means may be used to evacuate said storage chamber so that upon application of such vacuum pump means through said vacuum fitting, the said sealing cover will collapse and reduce the internal volume of the storage chamber, and effectively compress articles of travel stored therein to minimize the volume of storage required for said articles of travel;

a means for hinging said top cover component with said bottom receptacle component in side-by-side relationship so that said top cover component can be rotatably mated with said bottom receptacle component.

2. A luggage item, comprising:

an airtight bottom receptacle component and a substantially matching airtight top cover component, each said component having a bottom surface, a top surface, a rear surface, a front surface, and two opposing side surfaces respectively; and, on the bottom receptacle component there is provided at least one vertical compartment sidewall; said vertical compartment sidewall sealingly connected to said bottom receptacle component bottom surface to define at least one internal compartment therein for storage of articles of travel; said at least one internal compartment having a sealing rim; at least one flexible airtight sealing cover, said at least one sealing cover having a collapsible surface area bounded by a sealing edge that mates sealingly to a correspondingly matched internal compartment sealing rim to form an airtight storage chamber of variable volume; a vacuum fitting sealingly attached to said sealing cover so that a vacuum pump means may be used to evacuate said storage chamber so that upon application of such vacuum pump means through said vacuum fitting, the said sealing cover will collapse and reduce the internal volume of the storage chamber, and compress articles of travel stored therein to minimize the volume of storage required for said articles of travel.

3. The luggage item of claim 2, additionally comprising a check valve means sealingly attached to said sealing cover to allow air to only freely pass from said storage chamber to the atmosphere.

4. The luggage item of claim 2, additionally comprising a means for hinging said top cover component with said bottom receptacle component in side-by-side relationship so that said top cover component can be rotatably mated with said bottom receptacle component.

* * * * *